US005199648A

United States Patent [19]

Fujikawa

[11] Patent Number: 5,199,648

[45] Date of Patent: Apr. 6, 1993

[54] FUEL INJECTION VALVE

[75] Inventor: Takuya Fujikawa, Saitama, Japan

[73] Assignee: Zexel Corporation, Tokyo, Japan

[21] Appl. No.: 672,187

[22] Filed: Mar. 20, 1991

[51] Int. Cl.[5] ..... B05B 1/30

[52] U.S. Cl. ..... 239/585.4; 239/585.1; 251/129.21; 251/126

[58] Field of Search ..... 239/585.1, 487, 490, 239/585.3, 585.4; 251/129.21, 126, 129.14, 129.15, 129.22

[56] References Cited

U.S. PATENT DOCUMENTS

| | | | |
|---|---|---|---|
| 4,394,974 | 7/1983 | Saito et al. | 239/585.1 |
| 4,423,841 | 1/1984 | Palma | 251/129.15 |
| 4,483,485 | 11/1984 | Kamiya et al. | 251/129.21 |
| 4,494,701 | 1/1985 | Hensley et al. | 239/585 |
| 4,520,962 | 6/1985 | Momono et al. | 239/585.4 |
| 4,564,145 | 1/1986 | Takada et al. | 239/585 |
| 4,585,174 | 4/1986 | Knapp | 239/585.1 |
| 4,597,558 | 7/1986 | Hafner et al. | 239/585.1 |
| 4,648,559 | 3/1987 | Fuller | 239/585.1 |
| 4,798,188 | 1/1989 | Ito et al. | 239/585 |
| 4,798,329 | 1/1989 | Mesenich | 239/585.1 |
| 4,899,699 | 2/1990 | Huang et al. | 239/585 |
| 4,909,439 | 3/1990 | Fu | 239/585 |
| 4,915,350 | 4/1990 | Babitzka et al. | 239/585 |
| 4,946,132 | 8/1990 | Reiter | 239/585 |
| 4,995,559 | 2/1991 | Okamoto et al. | 239/585.4 |
| 5,040,731 | 8/1991 | Yokoyama et al. | 239/585 |

FOREIGN PATENT DOCUMENTS

| | | | |
|---|---|---|---|
| 0135264 | 8/1982 | Japan | 239/585 |
| 59-163171 | 11/1984 | Japan . | |
| 219350 | 9/1989 | Japan . | |
| 2039993 | 1/1979 | United Kingdom | 239/585 |

*Primary Examiner*—Andres Kashnikow
*Assistant Examiner*—Christopher G. Trainor
*Attorney, Agent, or Firm*—Nields & Lemack

[57] ABSTRACT

Herein disclosed is a fuel injection valve of electromagnetic control type, which is to be used in a gasoline engine. The fuel injection valve has a tubular control valve 5 fitted in a nozzle body 4, and an armature 7 is fitted on and welded to the outer circumference of the rear portion of said tubular control valve 5. On the leading end of the tubular control valve 5, moreover, there is fixed a ball 6 which has a diameter larger than that of the tubular control valve 5 and has its largest-diameter portion contacting linearly with the conduit 42 of the nozzle body 4. The ball 6 is formed in its region containing the tangent 60 with a plurality of grooves 62 which are angled to intersect the axis of the tubular control valve 5. The ball 6 functions not only as a valve seat but also stroke guide means and means for applying a rotational energy to the fuel.

10 Claims, 4 Drawing Sheets

Fig. 1-A
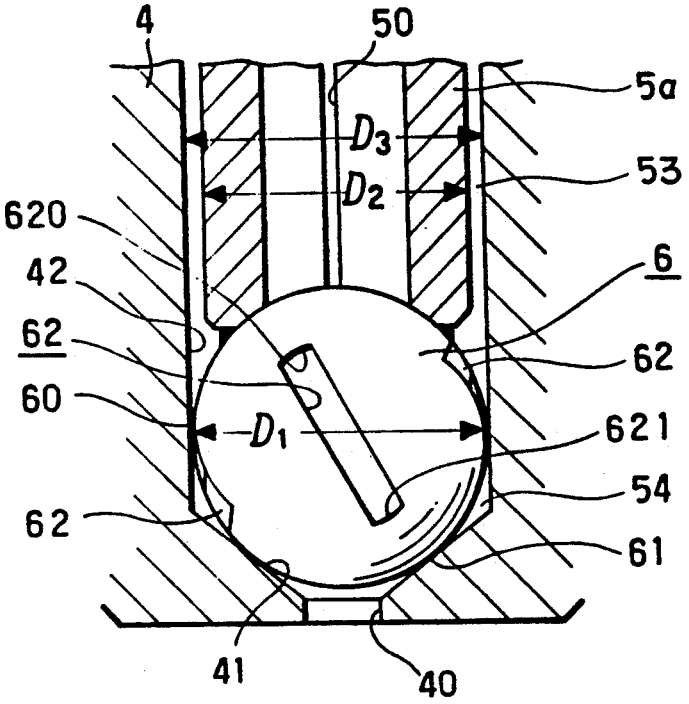
Fig. 2
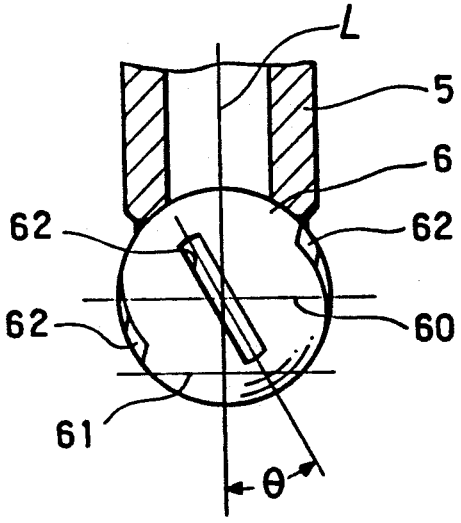

FUEL INJECTION VALVE

FIELD OF THE INVENTION

The present invention relates to a fuel injection valve for an internal combustion engine and, more particularly, to a fuel injection valve of the type for injecting a fuel fed under a low pressure by means of an solenoid valve.

BACKGROUND OF THE INVENTION

The gasoline engine may have a lower fuel feed pressure to an injection valve than that of the Diesel engine. Unlike the case of the Diesel engine, therefore, the fuel injection adopted is accomplished not by opening a needle valve by the pressure itself of the fuel but by lifting and opening a control valve by the electromagnetic force thereby to inject the fuel reserved in advance in a valve chamber. The amount of fuel injection is controlled by the time period for which the control valve is opened.

Thus, the fuel injection valve in this field is generally constructed by arranging a needle (or spindle) valve having a blunt leading end slidably relative to the nozzle body having an injection hole, by equipping the leading end of the needle valve with a liquid tight seat mechanism, by welding an armature to the rear portion of the needle valve, and by exerting a magnetic attraction upon the armature.

Moreover, the fuel injection valve of this kind is earnestly desired to have a finer atomization from the aspect of exhaust emission control. One fuel atomization is known in Japanese Patent Laid-Open No. 219350/1989.

This prior art is intended, by forming a short spindle-shaped sliding portion to contact with the cylindrical inner face of a valve body upstream of the seat portion of a needle valve and by forming a helical groove in that spindle-shaped sliding portion, to impart a rotational energy to the fuel passing through the helical groove thereby to establish a swirl when the needle valve is lifted.

Since, however, this prior art is formed with the helical groove all over the spindle-shaped sliding portion, the pressure is highly lost at that portion. Because the fuel pressure is low, moreover, the fuel will hardly diffuse even it flows helically, so that the injection characteristics are adversely affected. Since, on the other hand, the volume of the portion from the helical groove to the seat portion is large, the dead volume is inevitably increased to change the shape of atomization in dependence upon the period of the opening time of the needle valve. Specifically, at the beginning of the fuel injection, the helical groove itself forms part of the dead volume, in which the fuel has no rotational energy, so that the atomization takes the form of pencil stream.

Since, on the other hand, the aforementioned needle valve is lifted by the electromagnetic force, it is absolutely necessary for a proper injection of fuel that the needle valve is firmly joined to the armature. This joint structure is exemplified by a method of welding the tubular control valve or needle valve to the armature, as disclosed in the above-specified Japanese Utility Model Laid-Open No. 163171/1984.

In this prior art, however, it is necessary to machine and finish the external diameter of the tubular control valve and the internal diameter of the armature. Especially in case the laser welding is adopted as the welding method so that the radially inner edge of the lower end of the armature is welded on its whole circumference to the outer circumference of the tubular control valve, welding defects are caused, if the portions to be joined have a clearance, and still the worse the lift is dispersed. Thus, a strict sizing accuracy is required. As a result, there arises a problem that the production cost is extremely high. On the other hand, the lift of the tubular control valve is set in terms of the insertion position of the tubular control valve into the armature. In the prior art, however, the tubular control valve is press-fitted in the armature so that the fitting allowance is eliminated to produce defective articles if the needle valve is retracted in case the fitting size is excessively large. Thus, the prior art cannot be freed from the rise of the production cost and the reduction of the production yield.

SUMMARY OF THE INVENTION

The present invention has been conceived to solve the above-specified problems and has a fundamental object to provide a fuel injection valve of this kind, which can achieve excellent injection characteristics and atomizations with a simple and inexpensive structure.

In the fuel injection valves of this kind, the tubular control valve of the type having its leading end equipped with the ball is well known in the aforementioned Japanese Utility Model Laid-Open No. 163171/1984. In the prior art, however, the ball is used exclusively as the valve seat means. Therefore, the present invention has changed the concept of the ball seat type injection valve of the prior art by causing the ball to function not only as the valve seat member but also as stroke guide means and means for applying the rotational energy to the fuel.

Specifically, the fuel injection valve of the present invention is basically composed of a solenoid assembly, a nozzle body and a tubular control valve. The solenoid assembly is composed of a yoke having a cup-shaped portion and a cylindrical portion, a core having a passage for the fuel, and a coil surrounding the core. On the other hand, the nozzle body is formed into a cylindrical shape, which is formed with an injection hole at its leading end and a seat face at the back of the injection hole, and is fixedly fitted in the axial bore of the yoke of the nozzle body. The aforementioned tubular control valve is fitted in the nozzle body. Moreover, an armature is welded and fixed to the outer circumference of the rear portion of the tubular control valve.

In this fundamental structure, the present invention fixes a hard ball, which can come into and apart from the aforementioned seat face, at the leading end of the tubular control valve. The ball has its diameter larger than the external diameter of the tubular control valve and has its largest-diameter portion, i.e., tangent contacting with the conduit wall of the aforementioned nozzle body. The ball is formed in the region containing the tangent with a plurality of grooves which are angled to intersect the axis of the tubular control valve.

According to this structure, it is possible to reduce both the pressure loss of the fuel resulting from the diffusing grooves and the dead volume extending from the diffusing grooves to the valve seat. Moreover, the application of the swirling energy to the fuel and the valve lift guide are accomplished by making use of the ball as the seat member so that the structure is simplified.

In addition to the aforementioned object, a second object of the present invention is to provide a fuel injection valve which can ensure the joint between the tubular control valve and the armature indispensable for the proper injection and can realize the joint at a low cost.

In order to achieve the above second object, according to the present invention, the tubular control valve fixing the aforementioned ball to its lower end is specially constructed to have a spring function in the radial direction so that the relative movement to the armature and the temporary fixing may be accomplished before the tubular control valve is welded to the armature.

Specifically, in addition to the aforementioned structure, the tubular control valve is made of not a pipe having a closed section but a split pipe having an axial slit in one portion of the circumference. Moreover, the split pipe is fitted in the armature, while it is constricted to eliminate the slit, and is then released its constriction so that it is welded to the armature.

According to the structure thus far described, a proper size adjusting effect can be attained by the spring action of the split pipe. As a result, the tubular control valve can be reliably welded all over its circumference to the armature even if the internal diameter of the armature and the external diameter of the tubular control valve are not machined to especially high sizing accuracy. Moreover, setting of the lift is facilitated to reduce the defective percentage of the working so that an accurate injection valve can be attained in its entirety at a low cost. Because of the presence of the slit in the assembled state, moreover, the fuel having flown into the inside can be promptly fed to the valve chamber.

Incidentally, other advantages and structures of the present invention will be made apparent from the following detailed description and the accompanying drawings but can apparently be changed and modified in various manners without departing from the scope of the present invention.

BRIEF DESCRIPTION OF THE DRAWINGS

FIG. 1-A is an enlarged diagram showing the leading end portion of the fuel injection valve;

FIG. 2 is an explanatory diagram showing the angle of grooves of the fuel injection valve;

DETAILED DESCRIPTION OF THE PREFERRED EMBODIMENTS

The present invention will be described in the following in connection with the embodiments thereof with reference to the accompanying drawings.

Figure 1:
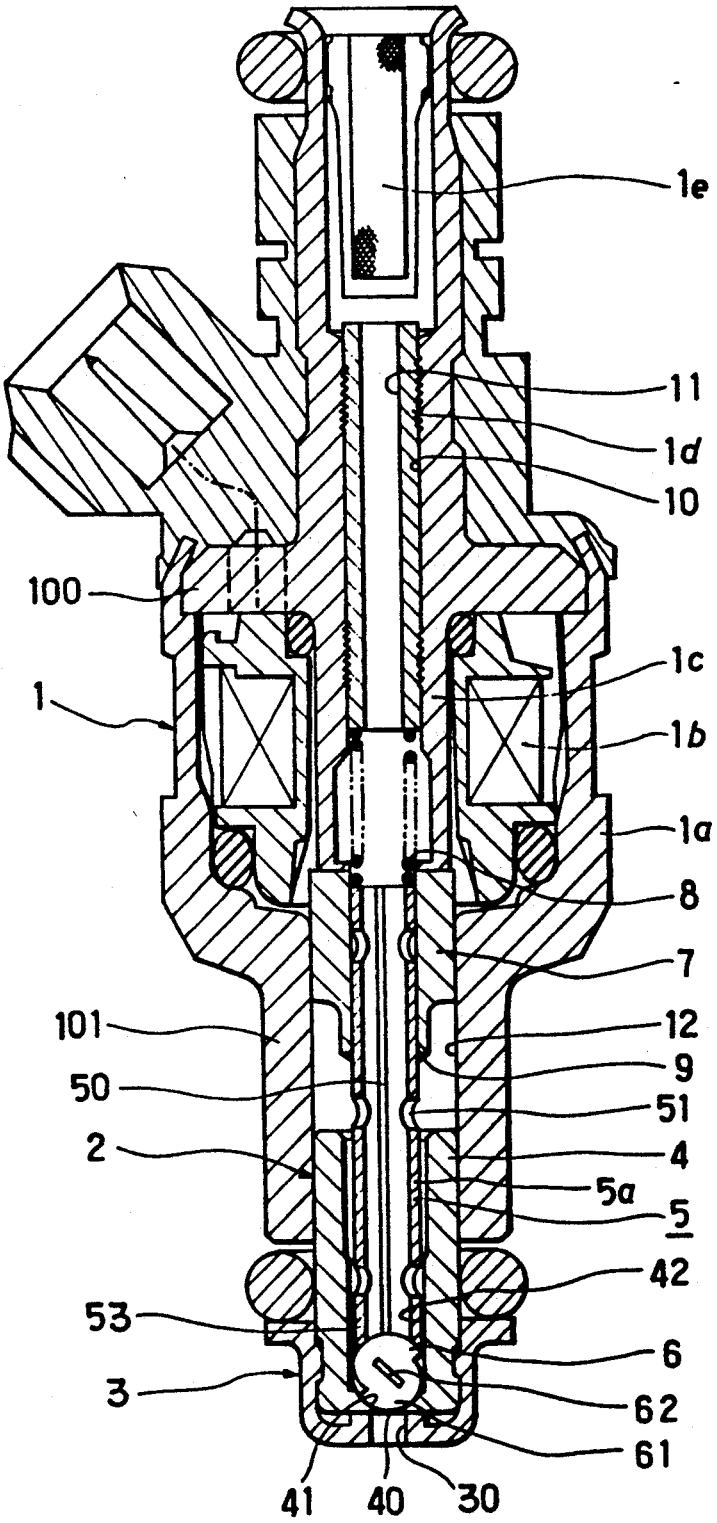
FIG. 1 is a section showing one embodiment of the fuel injection valve according to the present invention.

FIG. 1 shows one embodiment of the fuel injection valve according to the present invention.

In FIG. 1: reference numeral 1 designates a solenoid assembly; numeral 2 an injection valve assembly; and numeral 3 a mounting cap fitted on the leading end of a nozzle body 4 of the injection valve assembly 2.

The solenoid assembly 1 is composed of a yoke 1*a*, which is integrally formed below an upward cut-shaped portion with a cylindrical portion 101 having a smaller diameter than that of the cup-shaped portion, and a core 1*c* having its flange 100 fitted in the cup-shaped portion of the yoke 1*a*. In this cup-shaped portion, there is arranged a ring-shaped coil 1*b* having a center, through which the cylindrical shaft portion of the aforementioned core 1*c* extends. The core 1*c* is formed axially thereof with a through hole 10, which has its rear end expanded to fit a filter 1*e* therein. Into the through hole 10, there is screwed prior to the filter a pipe-shaped spring adjuster 1*d*, which is formed therein with a fuel feed bore 11 for guiding the fuel fed through the filter 1*e* downward.

The injection valve assembly 2 is composed of: the cylindrical nozzle body 4; a tubular control valve 5 fitted in the nozzle body 4 and equipped with a ball 6 coaxially at its leading end; and an armature 7 fitted and welded in the outer circumference of the rear portion of the tubular control valve 5. The aforementioned nozzle body 4 has its desired portion of the total length press-fitted or welded in an axial bore 12 which is formed in the cylindrical portion of the aforementioned yoke 1*a*, but the armature 7 is slidably fitted in the aforementioned axial bore 12.

As better seen from FIG. 1-A, the nozzle body 4 is formed with an injection hole 40 at the center of its leading end, a conical seat face 41 upstream of the injection port 40, and a stepped conduit 42 extending upward from the trailing end of the seat face 41. The mounting cap 3 is formed with an injection hole 30 which leads to the aforementioned injection hole 40.

The aforementioned tubular control valve 5 is formed with a plurality of fuel holes 51, which are arranged at a predetermined spacing in the longitudinal direction so that they may feed the fuel having passed an inside 52 through the aforementioned fuel feed bore 11 radially outward. Moreover, the tubular control valve 5 is urged downward, i.e., in the direction to close the valve by a spring 8 which is interposed between itself and the leading end face of the aforementioned spring adjuster 1*d*.

The aforementioned ball is made of a hard material into a true sphere or ellipsoid and is welded by the laser beam, for example, to the leading end of the tubular control valve 5. As seen from FIG. 1-A, the ball has an external diameter $D_1$ larger than the $D_2$ of the tubular control valve 5 and equal to the internal diameter $D_3$ of the conduit 42. As a result, the ball 6 linearly contacts with the conduit 42 at its largest-diameter portion so that an annular passage 53 for allowing free path of the fuel is generated between the outer circumference of the tubular control valve 5 upstream of the tangent 60 (as better seen from FIG. 2) and the conduit 42.

Moreover, the aforementioned ball 6 is formed downstream of the aforementioned tangent 60 with a seat face 61 which can linearly contact with the conical seat face 41. The ball 6 is further formed, in its surface in the region containing the largest-diameter portion, i.e., the tangent 60 with a plurality of grooves 62 which intersect the axis L of the tubular control valve L at a predetermined angle $\theta$. The aforementioned grooves 62 are provided four in number in the present embodiment and are made linear, as viewed in a top plan, and should not be limited thereto but may be arcuate.

The aforementioned angle $\theta$ may be equal for all the grooves 62 or different. In case three or more grooves 62 are formed, some of them have an equal angle but the remainder may have different angles.

The individual grooves 62 have to be present at least partially on the tangent 60, but their lengths across the tangent 60 need not always be equal but may be unequal. Despite of this fact, however, the grooves 62 may have their lower (or downstream) ends 621 extend close to the seat face 61 but not arriving thereat. The upper (or upstream) ends 620 may reach just vicinity of the welded portion to the tubular control valve 5. The depth of the grooves 62 may be constant all over the length but may be the deepest at the region corresponding to the tangent 60 and gradually decreased toward the upper ends 620 and the lower ends 621. Still moreover, the groove width need not always be equal all over the length. That is, the grooves 62 may become the wider or narrower as the closer to the lower ends 621.

Figure 3:
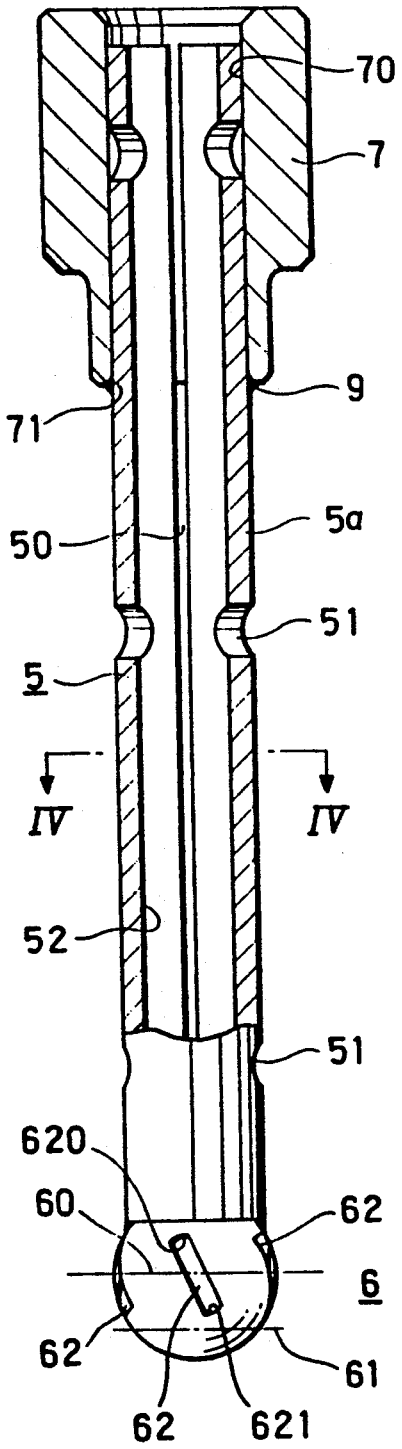
FIG. 3 is a partially cut-away enlarged diagram showing the single unit of the injection valve assembly integrated with an armature.
Figure 4:
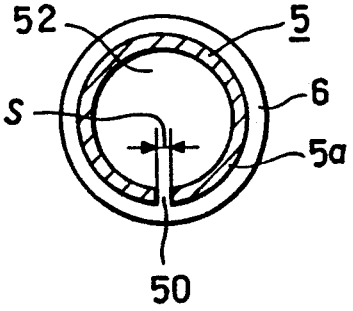
FIG. 4 is a section taken along line IV—IV of FIG. 3.
Figure 5:
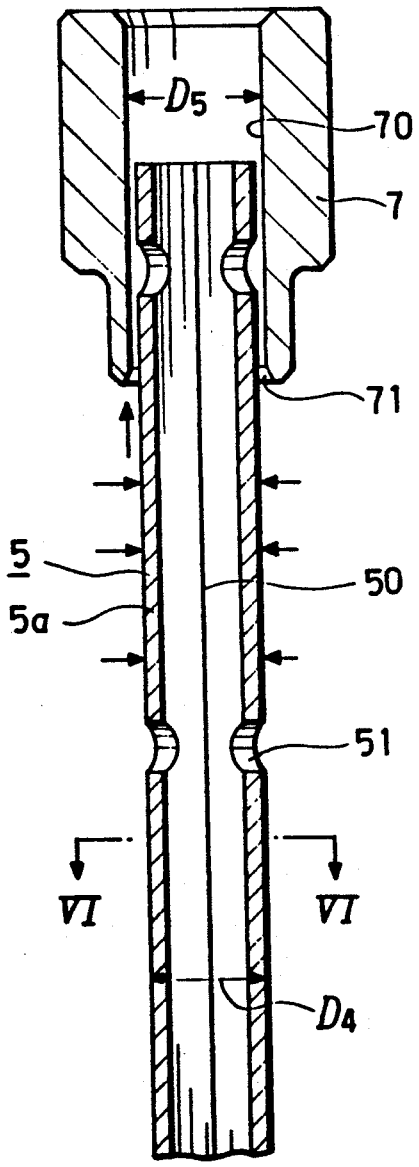
FIG. 5 is a section showing the assembled state of a tubular control valve and the armature.

The aforementioned tubular control valve 5 may be made of a pipe having a closed section. Preferably, however, the pipe may be a split pipe 5*a* which is formed with an axially extending slit 50, as shown in FIGS. 1, 3 and 4. The width S of the slit 50 is suitably set, as shown in FIG. 5, such that the split pipe 5*a* has an external diameter $D_4$ smaller than the internal diameter $D_5$ of the armature 7, when it is constructed, and larger than the internal diameter $D_5$ when the same is released from its compression.

In the assembly state of FIGS. 3 and 4, the split pipe 5*a* is brought into close contact with the inner circumference 70 of the armature by the spring action of the slit 50, and the annular groove, which is formed by the split pipe 5*a* and the internal edge 71 of the lower end of the armature 7 is welded by the laser beam around the whole circumference. Numeral 9 designates a seam-welded portion. In this state, moreover, the ball 6 is also welded by the laser beam to the lower end of the split pipe 5*a*. As the case may be, the slit 50 need not reach the lower end of the split pipe 5*a*.

OPERATION

FIG. 1 shows the valve closed state, in which the tubular control valve 5 is urged from the back by the spring 8, so that the ball 6 integrated with the leading end of the tubular control valve 5 has its seat face 61 contacting liquid-tight with the seat face of the nozzle body 4 to close the injection hole 40.

The fuel is fed from the not-shown pump means and flows through the filter 1*e* and from the fuel feed bore 11 into the inside 52 of the tubular control valve 5 arranged coaxial with the fuel feed bore 11. The fuel further flows via the oil hole 51 into the axial bore 12 and the conduit 42 and at the same time out of the slit 50 via the annular passage 53 between the conduit 42 and the annular control valve 5 until it reaches the tangent 60, i.e., the largest-diameter portion of the ball 6. Here, the fuel has its almost flow rate restricted and flows through the grooves 62, which are formed across the tangent 60, until it is reserved in the space 54 which is defined by the ball outer circumference upstream of the seat faces 41 and 61 and the conduit 42. This charge of fuel is quickly effected through the slit 50.

If, in this state, the coil 1*b* is energized, a magnetic circuit is established by the core 1*c*, the yoke 1*a* and the armature 7 so that the armature 7 is attracted by the core 1*c*. As a result, the tubular control valve 5 integrated with the armature 7 is lifted against the urging force of the spring 8 so that the seat face 61 of the ball 6 leaves the seat face 41 of the nozzle body 4.

At this lifting time, the ball 6 always has its tangent 60 contacting linearly with the conduit wall, and the tubular control valve is smoothly guide because its upper portion guided by the sliding contact between the armature 7 and the axial bore 12.

At the beginning of the injection, the fuel reserved in the aforementioned space 54 is injected from the injection hole 40, and the fuel upstream of the annular passage 53 is restricted by the tangential region, because of the linear contact between the tangent 60 of the ball and the conduit wall, so that it is atomized via the grooves 62 across the tangent 60 out of the injection hole 40.

Since the seal faces 41 and 61 are positioned close to the tangent 60, the space 54 has a small volume to reduce the dead volume. Moreover, the grooves 62 do not reach the seal face 61 even in case the grooves are the longest. As a result, the atomization has its shape little changed by the pulse width of the solenoid assembly 1 so that it is prevented from taking a pencil stream.

In the present invention, moreover, the ball 6 has its largest-diameter portion providing the stroke guide to contact with the conduit wall so that the are for the fuel to pass therethrough is always constant without any relation to the lift of the valve. The place where the fuel is throttled is located only at the tangent 60 of the ball. Moreover, the throttle portion is formed with the grooves 62, which extend along such portions of the spherical surface as have passed over the maximum diameter of the ball. As a result, the fuel has little pressure loss even if it has the grooves 62. Thus, the fuel is atomized in a fine particles at a stable injection rate from the injection hole 40 while being given a swirling energy effectively from the grooves 62.

Since the extension of the atomization can be freely set by the angle $\theta$ of the grooves 62 formed in the ball 6, the degree of freedom for the requirement of the engine side can be increased. In case, moreover, the tubular control valve 5 is made of the split pipe 5*a*, the axial bore 12 and the conduit 42 can be promptly filled up with the fuel, as has been described hereinbefore.

Figure 6:
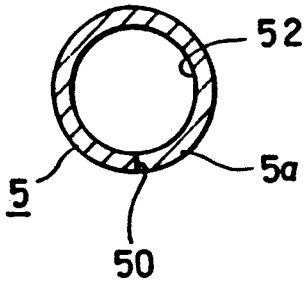
FIG. 6 is a section taken along line VI—VI of FIG. 5.

At the time of welding to the armature, on the other hand, the split pipe 5*a* is compressed to the smaller diameter, as shown in FIGS. 5 and 6. Thus, the split pipe 5*a* has its external diameter smaller than the internal diameter of the armature 7 so that it can be freely inserted into the armature 7. As a result, it is possible to adjust the depth of insertion conveniently and accurately for setting the stroke of lift.

When the split pipe 5*a* reaches the predetermined depth, it is released from its compressed state. Then, the slit 50 is widened to increase the diameter of the split pipe 5*a* so that the split pipe 5*a* is brought into close contact with the inner face 70 of the armature 7 and accordingly into the partially constricted state by the spring action. Since, on the other hand, the outer circumference of the split pipe 5*a* at the boundary between the constricted zone and the unconstricted zone will bulge, the gap between the split pipe 5*a* and the radially inner edge of the lower end of the armature 7 is reduced. If, therefore, the laser welding is performed in this state, there can be attained an excellent seam welded portion having no welding defect. As a result, the welding works of the armature 7 and the tubular control valve 5 can be accomplished remarkably simply, accurately and reliably so that the tubular control valve 5 can have its lift accuracy and durability improved excellently.

I claim:

1. A fuel injection valve comprising:

i) a solenoid assembly 1 including a yoke 1*a* having a cup-shaped portion, an axial bore 12 and a cylindrical portion 101, a core 1*d* having a fuel conduit 11, and a coil 1*b* enclosing said core 1*d*;

ii) a nozzle body 4 fitted and fixed in the axial bore 12 of said yoke 1*a*, said nozzle body being cylindrical and having an injection hole 40 at its leading end and a seat face 41 at the back of said injection hole 40; and iii) a tubular control valve 5 fitted in said nozzle body 4, said tubular control valve 5 having a ball 6 fixed at its leading end and enabled to come into output contact with said seat face 41, said tubular control valve 5 having an armature 7 fitted in and affixed to the outer circumference of its rear portion, said armature 7 being lifted by energizing said coil 1*b*, iv) wherein the ball 6 at the leading end of said tubular control valve 5 has a diameter larger than that of said tubular control valve 5 and equal to the internal diameter of said nozzle body 4, an annular fuel passage 53 being formed between said tubular control valve and said nozzle body and a fuel reserve space 54 being formed between said ball, said seat face 41 and a conduit 42 of said nozzle body and wherein said ball 6 contacts with said conduit 42 of said nozzle body 4 at its largest-diameter portion corresponding to a tangent 60, and wherein said ball 6 is formed in its region containing said tangent 60 with a plurality of grooves 62 which are angled to intersect the axis of said tubular control valve 5.

2. A fuel injection valve according to claim 1, wherein said grooves 62 have their lower ends short of a seat face 61 and substantially equal upper and lower lengths across said tangent 60.

3. A fuel injection valve according to claim 1, wherein said grooves 62 have their lower ends short of a seat face 61 and unequal upper and lower lengths across said tangent 60.

4. A fuel injection valve according to claim 1, wherein said grooves 62 have a constant width.

5. A fuel injection valve according to claim 1, wherein said grooves 62 have different widths at their upper and lower ends.

6. A fuel injection valve according to claim 1, wherein said grooves 62 are the deepest in the region corresponding to said tangent 60 and are gradually shallowed toward their upper and lower ends.

7. A fuel injection valve according to claim 1, wherein said grooves 62 individually intersect the axis of said tubular control valve 5 at an equal angle.

8. A fuel injection valve according to claim 1, wherein said grooves 62 individually intersect the axis of said tubular control valve 5 at different angles.

9. A fuel injection valve according to claim 1, wherein said tubular control valve 5 is made of a pipe having a closed section.

10. A fuel injection valve according to claim 1, wherein said tubular control valve 5 comprises a split pipe having a slit 50 axially extending in a circumferential portion, said split pipe being capable of temporary constriction about said slit 50 so as have an external diameter smaller than the internal diameter of said armature 7 to allow for insertion into said armature 7, and upon release of said constriction, said split pipe having an external diameter larger than said internal diameter of said armature 7.

* * * * *